United States Patent [19]

Kleefeldt et al.

[11] 4,257,634

[45] Mar. 24, 1981

[54] VEHICLE DOOR LOCK CONTROL

[75] Inventors: Frank Kleefeldt; Lothar Krause, both of Heiligenhaus, Fed. Rep. of Germany

[73] Assignee: Arn. Kiekert Söhne, Heiligenhaus, Fed. Rep. of Germany

[21] Appl. No.: 34,412

[22] Filed: Apr. 30, 1979

[30] Foreign Application Priority Data

Apr. 29, 1978 [DE] Fed. Rep. of Germany ..... 2819143

[51] Int. Cl.[3] ..... E05C 0/00

[52] U.S. Cl. ..... 292/336.3; 292/201

[58] Field of Search ..... 292/336.3, 144, 201; 74/84 R, 57

[56] References Cited

U.S. PATENT DOCUMENTS

| | | | |
|---|---|---|---|
| 1,993,797 | 3/1935 | Peterson | 74/57 |
| 2,735,202 | 7/1956 | Smith et al. | 292/201 X |
| 3,548,619 | 12/1970 | Purdy | 70/279 X |
| 4,135,377 | 1/1979 | Kleefeldt et al. | 292/201 X |

*Primary Examiner*—Richard E. Moore

*Attorney, Agent, or Firm*—Smyth, Pavitt, Siegemund, Jones & Martella

[57] ABSTRACT

A remote controlled door lock unit includes a motor for driving a worm gear having stop elements at its ends for abutment with a travelling nut; and having tangentially facing stop and counterstop surfaces. The axially moved nut drives the lock actuator. The motor is turned on via a time relay just to drive the nut from one to the opposite stop position.

4 Claims, 4 Drawing Figures

7
16a
16b
33
23
6a
6
6b
4'
4
7

6
6b
7
16b
33
4
16a
6a
23
S

VEHICLE DOOR LOCK CONTROL

BACKGROUND OF THE INVENTION

The present invention relates to a centrally operated locking device for the doors of a vehicle.

Locking systems of the type to which the invention pertains usually include a locking drive for each door and a central control and command unit for all of these drives. Each drive should be constructed with a manual override. Our U.S. Pat. No. 4,135,377 discloses such a system wherein particularly each drive unit includes a reversible motor for driving a worm gear, and a travelling nut runs on that gear in axial direction as the worm rotates. This nut, in turn, is coupled to the door lock actuator.

Our patent discloses specifically switches for controlling and limiting the travelling range of the nut on the worm. These switches turn the motor off in order to avoid thermal overload when the nut hits a stop. The motor is additionally protected by a temperature-sensitive element, should the switches fail. Without protection in one form or another, the motor will stop whenever the nut hits an impediment, but the current will drastically increase unless turned off.

It has now been discovered that in the case of switch failure, the nut may, for example, be driven against stop surfaces in such a manner that strong friction occurs between the nut and the surface. For example, in our patent, the nut can be driven against and onto the unthreaded portion of the worm spindle and strong friction will hold it. Upon reversing the motor, the friction may be too strong so that rotating the spindle will not pry the nut loose. It should be noted that this problem is unrelated to the overload clutch which is the specific subject of that patent. The problem presently alluded to occurs only in the case of equipment failure.

DESCRIPTION OF THE INVENTION

It is an object of the present invention to provide a new and improved arrangement for stopping a door lock drive motor, avoiding the problems posed by the mere use of end switches.

It is a further object of the present invention to improve the system of our U.S. Pat. No. 4,135,377 as far as avoiding problems resulting from equipment failure is concerned.

It is a specific object of the present invention to improve a system for the remote control of door lock mechanisms which include, for such a door, a reversible motor driving a worm gear or spindle on which rides a travelling nut which, in turn, is linked to the door lock actuator.

In accordance with the preferred embodiment of the present invention, the assembly as per the specific object is improved by providing the two ends of the worm gear with secured or integral stop elements rotating therewith and serving as stops for the travelling nut through tangentially-facing, preferably plane surfaces and by providing timing means for restricting the period in which the motor can drive the worm or spindle in one direction. This way the motor shaft and worm is halted positively upon abutment between nut and worm stops and the timing means, e.g., a timing relay will shortly thereafter turn the motor off.

DESCRIPTION OF THE DRAWINGS

Proceeding now to the detailed description of the drawings, FIG. 1 shows a case 1 for a door lock drive unit, the case being preferably made of a synthetic and containing to one side a drive motor 2. The motor has a shaft 3, and a threaded spindle or worm gear 4 is secured or coupled to that shaft. The opposite end of the gear 4 is journalled in bearings 5 being affixed to the case.

Figure 1:
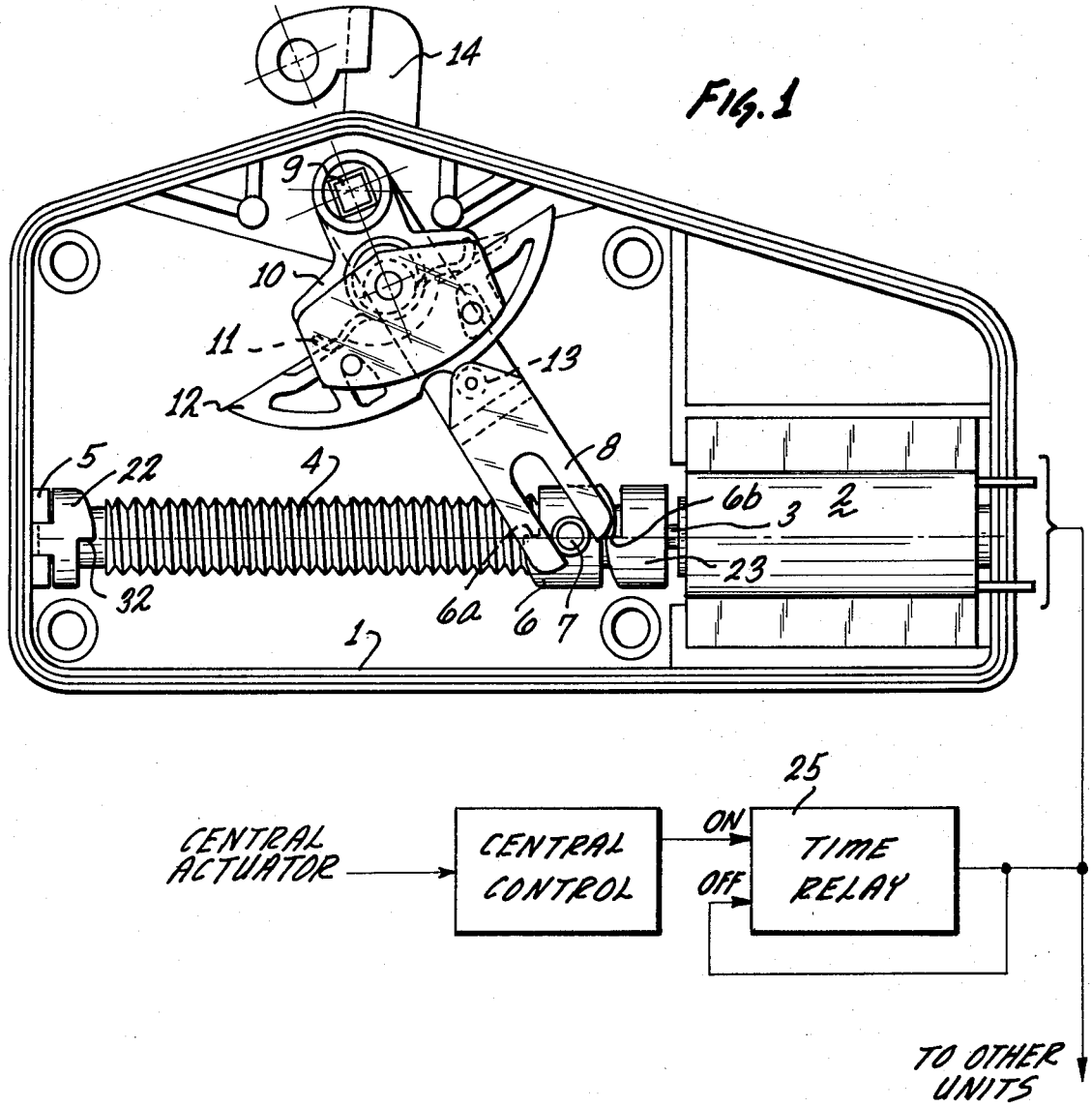
FIG. 1 is a side view into a unit in accordance with the preferred embodiment of the invention.

A travelling nut 6 sits on and is threadedly received by the gear 4; the nut will move along the axis as the worm gear rotates whereby, of course, the direction of movement by the nut is determined by the sense of rotation of the motor shaft. It should be mentioned that the axial path of the nut is rather precisely defined by a particular number of threads (at a pitch S) on the worm gear so that the length of that path is predetermined.

Nut 6 carries a pin 7 which is received in a cam slot of an arm or lever 8 being pivoted on a pin or shaft 9. A coupling plate 10 as well as a drive arm or lever 14 are connected and secured to shaft 9, turning therewith. Plate 10 carries a two-arm spring 11 which, in turn, urges a cam member 12 against a roller 13 on lever 8. Parts 10, 11, 12, and 13 establish an overload clutch by means of which lever 8 can be coupled to, as well as released from, shaft or pin 9 for the purpose of load depending pivoting arm 14. Arm 14 is connected to the door lock actuator. The overload clutch as well as the connection to the lock actuator is described in greater detail in our U.S. Pat. No. 4,135,377 whose content is incorporated by reference.

Motor 2 receives current through a control circuit which includes a Central Control of the type in which a Central Actuator, or the like, cause this motor 2 as well as all the other door lock motors of the vehicle to be energized. The energization is not a direct one; rather, a timing means such as a time relay is interposed. The Central Control triggers the relay which holds via a timing circuit and is turned off after a particular period. That period is just a little larger than the period required to drive nut 6 from one stop position to the opposite one. We shall describe next how these positions are established.

Stop and cam elements 22 and 23 are secured to opposite ends of worm gear 4, rotating therewith but being otherwise impeded from independent rotation. Cam 23 as shown specifically has a tangentially-facing surface 33 which runs through axis 4' of the worm (and of the motor shaft). Cam 22 has a similar surface 32. Nut 6 carries corresponding cam or stop elements 6*a*, 6*b* which, respectively, coact with elements 22, 23 whenever the nut arrives in their vicinity. Specifically, the cam or stop elements on nut 6 have also tangentially-facing counterstop surfaces 16*a* and 16*b*.

FIG. 1 shows nut 6 adjacent to element 23. In fact, the tangentially or azimuthally facing, plane axis-parallel surface or stop face 16*b* of element 6*b* abuts the corresponding but oppositely directed plane face 33 of element 23. These surfaces are shown in disengaged position in FIG. 2.

Figure 2:
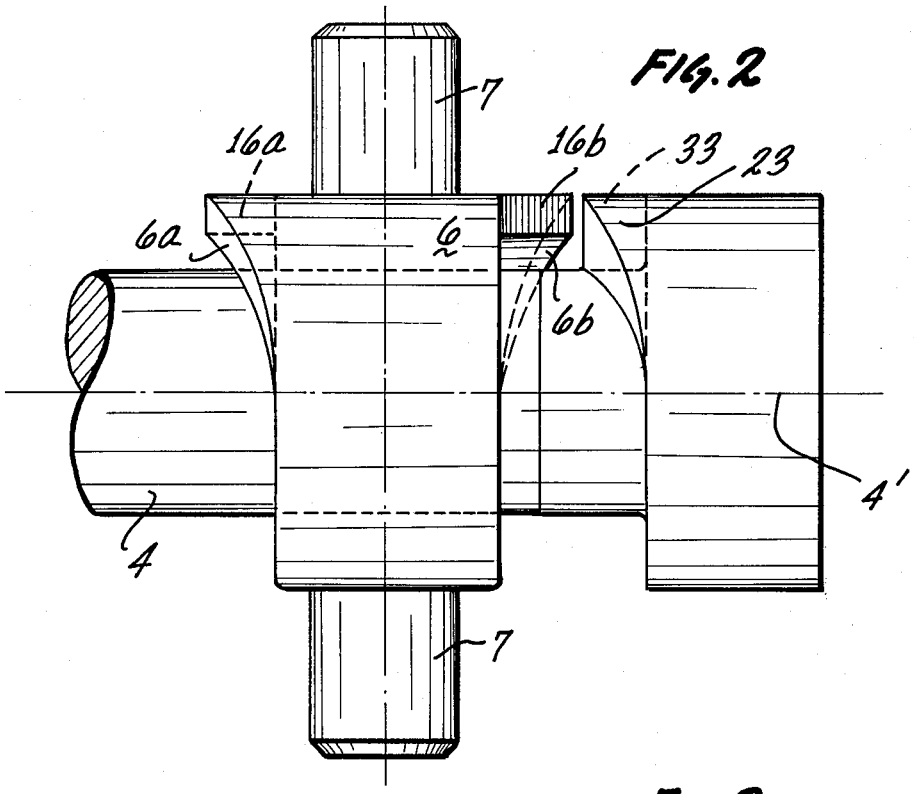
FIG. 2 shows a portion of a worm gear and a travelling nut on the gear, being a part of the unit shown in FIG. 1 and showing specifically an improvement as per the preferred embodiment.
Figure 3:
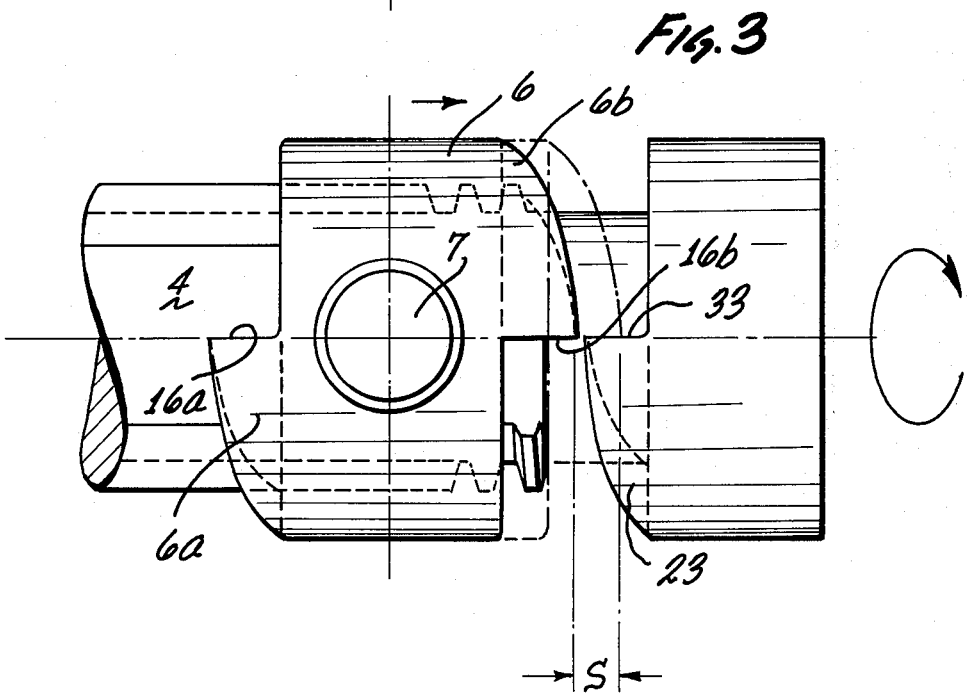
FIG. 3 is a view similar to FIG. 2 and as identified therein by lines 3—3.

FIGS. 2 and 3 show a position of nut 6 in which the rotating stop element 23 just misses counterstop **6*b*. After one more revolution, nut 6 is shifted to the right, corresponding to pitch S of the worm gear, and stop 6*b* assumes the dash-dot position in FIG. 3. Now, the two stop faces 16*b* and 33 abut and the motor is stopped. By ensuring that the last turn begins by just clearing between the nut stop element and the worm stop element, one makes sure that the motor is halted by positive, relatively large surface engagement as between stop surface and counterstop surface. Shortly thereafter, timing relay 25** will turn the motor current off. The time delay is selected sufficiently small so that the motor current remains, for a stopped motor, insufficient to heat it. It can thus be seen that the invention obviates the dependancy of the motor control on end switches and temperature-sensitive relays, though a thermostat control could be used as a redundant safeguard if the time relay malfunctions.

Figure 4:
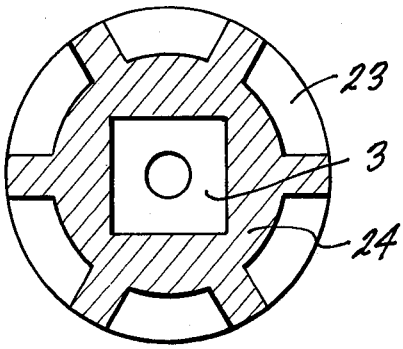
FIG. 4 is an optional detail for the parts in FIGS. 2 and 3.

It is preferred to provide element 23 with a hollow interior for receiving an elastic coupling 24 by means of which spindle or worm gear 4 is coupled to motor shaft 3. Such a coupling 24 is shown in FIG. 4. This elastic coupling removes the shock from the motor which would occur otherwise. Interpositioning of such a clutch is not essential as far as the specific objective of the invention is concerned, but is clearly preferred in practice. Independently therefrom, elements 22 and 23 are made preferably of an impact cushioning and attenuating plastic such as a polyamid.

In one form of practicing the invention, one can injection mold gear 4 and stop elements 22 and 23 as one uniform or integral piece. This way one can predetermine, without possible error, how the position of the stop surfaces of these elements 22 and 23 are to be related to the threads of the gear. In this case, however, one has to construct the nut as a two-piece unit to be placed laterally on the gear and to be interconnected when in place. Conceivably, one stop is made integral with the worm and the other one is subsequently secured thereto after an integral nut has been threaded on the worm.

If one or both stop elements 22, 23 are made, e.g., machined separately, one has to adjust their position prior to securing them to gear 4 in the following manner. After turning n-times, from one stop position, the respective elements **22-6*a* (or 23-6*b***) should just clear and after one more shaft revolution, the respective surfaces should firmly abut.

The invention is not limited to the embodiments described above, but all changes and modifications thereof not constituting departures from the spirit and scope of the invention are intended to be included.

We claim: /

1. In a centrally controlled system for locking the doors of a vehicle, a unit for controlling locking of one of the doors including a motor, a worm gear connected to a drive by the motor, a travelling nut for riding on the gear upon rotation thereof and means for connecting the nut to a door lock operating mechanism, the improvement comprising:

a first pair of stop elements secured respectively to opposite ends of the gear, rotating therewith, and having tangentially-facing stop surfaces;

a second pair of counterstop elements on the travelling nut having tangentially-oriented counterstop surfaces for respectively abutting with the stop surfaces of the elements of the first pair, to stop rotation of the gear upon such abutment and to thereby stop rotation of the motor; and timing means to limit the time the motor runs to approximately the period it takes to drive the travelling nut from one of the first pairs of stop elements to the respective other one.

2. The improvement as in claim 1 wherein the respectively abutting surfaces of the elements of the first and second pair are plane surfaces extending in planes which run through an axis of rotation of the gear.

3. The improvement as in claim 1 therein at least one stop element is integral with the worm gear.

4. The improvement as in claim 1 or 3, there being an elastic coupling interposed between the motor shaft and the worm gear.

* * * * *